United States Patent [19]

Nyst

[11] 4,409,883

[45] Oct. 18, 1983

[54] GAS OPERATED FIREARM

[76] Inventor: Edouard Nyst, Chemin de la Rouveyrolle, 13360-Roquevaire, France

[21] Appl. No.: 270,023

[22] Filed: Jun. 3, 1981

[51] Int. Cl.[3] ..... F41C 5/02

[52] U.S. Cl. ..... 89/192

[58] Field of Search ..... 89/192

[56] References Cited

U.S. PATENT DOCUMENTS

| | | | |
|---|---|---|---|
| 1,010,899 | 12/1911 | Halle | 89/192 |
| 2,981,158 | 4/1961 | Fletcher | 89/192 |
| 4,015,512 | 4/1977 | Feerick | 89/192 |

*Primary Examiner*—Stephen C. Bentley

*Attorney, Agent, or Firm*—LeBlanc, Nolan, Shur & Nies

[57] ABSTRACT

A gas operated firearm having means for initially storing energy from the gases released during discharge of a bullet is disclosed. The firearm includes a piston and cylinder arrangement which receives such gases, with the piston moving forwardly to compress a spring and operate a latch mechanism to maintain the spring in the compressed condition. The latch mechanism may be released by the operator when it is desired to reload the firearm, with reloading being accomplished by operation of an interengaging piston connecting rod and slide connecting rod.

1 Claim, 8 Drawing Figures

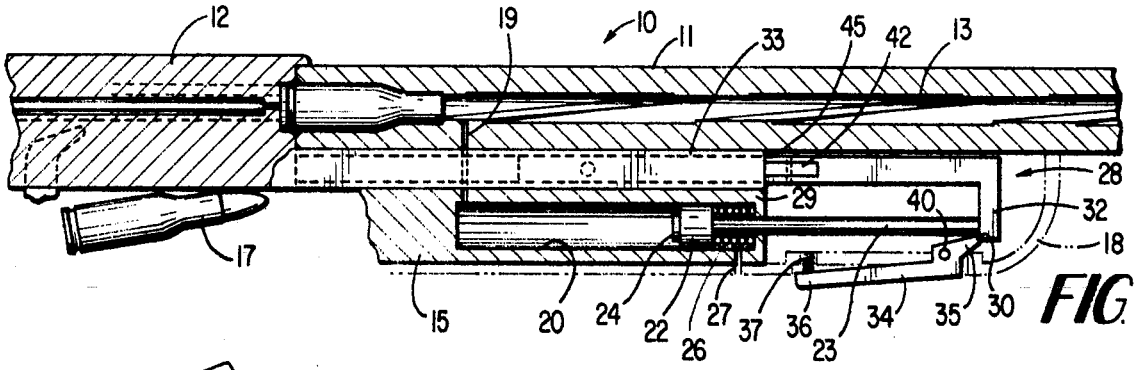
FIG. 1
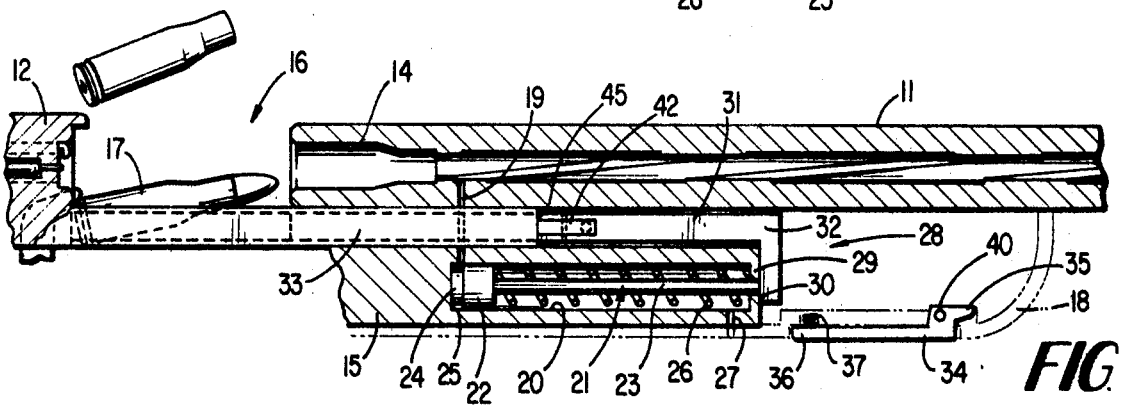
FIG. 2
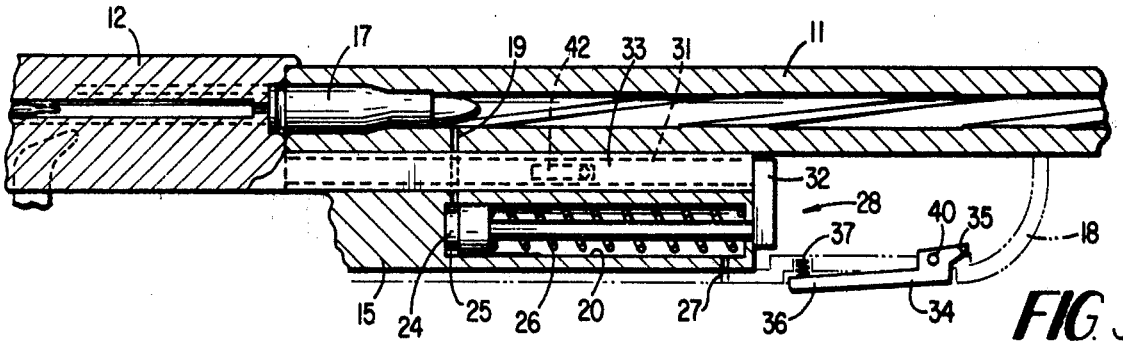
FIG. 3
FIG. 4
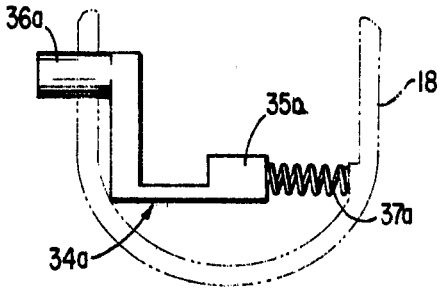
FIG. 5
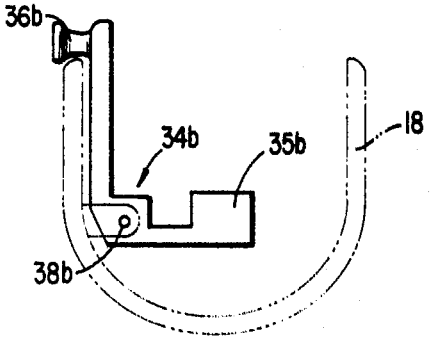

GAS OPERATED FIREARM

BACKGROUND AND SUMMARY OF THE INVENTION

The present invention relates to a gas operated firearm. More particularly, the present invention relates to a gas operated firearm, in which the gases released following the discharge of a bullet are employed to actuate an energy storage device within the weapon, and with the capability for release of such energy to reload the weapon at such time as desired by the operator.

Previous devices for use in delayed reloading of a firearm by the use of the energy released during discharge of a bullet therefrom includes such devices as described in U.S. Pat. Nos. 1,010,899; 2,981,158; and 4,015,512. U.S. Pat. No. 1,010,899 discloses an automatic firearm in which the gases released upon firing are employed to compress a pair of springs. The springs are allowed to remain in a locked position until a thumb piece is depressed, after which the firearm automatically ejects the empty shell and loads a fresh cartridge. U.S. Pat. No. 2,981,158 discloses a power system for firearms whereby the firearm operating mechanism is energized by gas pressure from an exploded cartridge indirectly so as to eliminate the impact of such gas pressure against the operating mechanism. U.S. Pat. No. 4,015,512 discloses a firearm wherein energy from the high pressure gases supplied by a detonating cartridge is stored, and thereafter this energy is employed to operate the breech bolt when the gas pressure in the barrel has dropped to a comparatively low level.

By the present invention, there is provided an improved gas operated firearm, in which the gases released through the barrel following the discharge of a bullet therefrom are employed to actuate a piston to a forward position within a cylinder located adjacent the barrel of the firearm. The piston head compresses a spring located in the forward end of the cylinder as the piston head moves forwardly, and a forward extension of the piston, in the form of a piston connecting rod located exterior to the cylinder, engages a latch mechanism in the forestock portion of the firearm. The spring is thus maintained in a compressed condition until the latch mechanism is released, at which time the spring causes the piston connecting rod to move rearwardly, engaging a slide connecting rod which in turn engages the slide to open the bolt and eject the empty shell. Upon ejection of the shell, the return spring of the firearm moves the slide forward in a conventional manner, and in so doing returns the slide connecting rod to its original position, the slide connecting rod telescoping on the piston connecting rod, bringing a new round into the barrel ready to be fired.

BRIEF DESCRIPTION OF THE DRAWINGS

The advantages and features of the gas operated firearm of the present invention will be more fully understood from the following description of the preferred embodiments, taken in conjunction with the accompanying drawings, wherein:

FIG. 1 is a side elevation in partial cross-section of a gas operated firearm in accordance with the present invention, showing the parts in position immediaely following the firing of a round, with the piston in the forward latched position;

FIG. 2 is similar in FIG. 1 but with the piston having been released and moving to the rear position upon actuation by the cylinder spring, the bolt thus being fully opened and the empty shell thrown out of the barrel;

FIG. 3 is similar to FIG. 2 but showing the slide connecting rod having been returned to its original position, bringing a new round into the barrel ready to be fired;

FIGS. 4 and 5 show cross-sectional views of various embodiments of the forearm mechanism for releasing the piston from the forward latched position;

DESCRIPTION OF THE PREFERRED EMBODIMENTS

Figure 6:
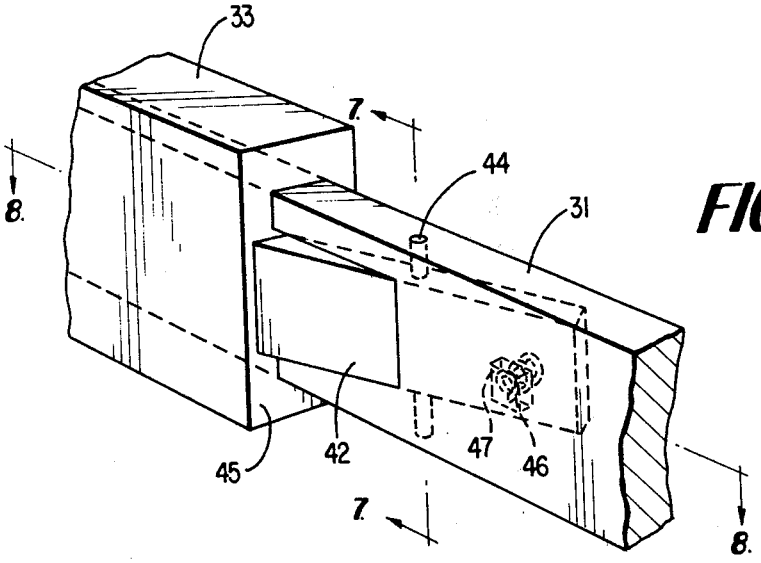
FIG. 6 is a partial perspective view showing the relationship between the slide connecting rod and the piston connecting rod.

In the illustrated embodiment of the present invention as shown in FIGS. 1 through 8, a gas operated firearm 10 is provided, having a barrel 11 secured to receiver 12, said barrel 11 having a bore 13 which extends to the forward end thereof and a chamber 14 for holding a round ready for firing.

A magazine 15 is mounted on the underside of the receiver 12 below the ejector opening 16, said magazine 15 holding additional rounds 17 of ammunition for loading into the chamber 14, as described hereinafter. A forestock or hand grip 18 is secured under the barrel 11 forward of the magazine 15. The forestock 18 is of a generally U-shape in cross-section, as shown in FIGS. 4 and 5, and provides a means of gripping and steadying the firearm 10, in accordance with standard practice.

A vertical gas port 19 is located in the barrel 11 just forward of the chamber 14 and extends downwardly below the barrel 11 to provide fluid communication for gases to pass between the bore 13 and a cylindrical chamber 20 which is located in the forward end of the magazine 15 and which extends parallel to the barrel 11. Positioned within the cylinder 20 is a piston member 21 having head 22 mounted in gas-tight, sliding relationship with the interior walls of cylinder 20, said head 22 being connected to rod 23, and with a flange 24 of smaller diameter than the piston head 22 being located on the rear portion of the piston head 22 and secured thereto, thus providing an annular space 25 for passage of gases into the chamber 20 from the bore 13, as shown in FIG. 2.

A compressible coil spring 26 is mounted on the piston rod 23 with the forward end seating against the forward end of the chamber 20 and with the rear end of the spring 26 seating against the forward surface of the piston head 22. The compressibility of the spring 26 is such that, upon compression, the spring 26 will allow the piston head 22 to move forwardly to the position shown in FIG. 1, with gases (primarily air) located forward of piston head 22 being vented through vent 27, and with the piston head 22 moving sufficiently forward to allow latching of the piston connecting rod, as described hereinafter. Upon release of the latching mechanism, the force of the spring 26 should be sufficient to move the piston head 22 rearwardly to the position shown in FIG. 2, so that the rear surface of the flange 24 seats against the rear end of the chamber 20.

The piston rod 23 extends through the plug 29 which forms the forward end of chamber 20, as shown in FIG. 1, with the rod 23 being in sliding, gas-tight relationship with the plug 29. Located at the forward end of the piston rod 23 is a L-shaped piston connecting rod 28, said connecting rod 28 being secured to the rod 23 so as to form a notch 30 in the lower portion of the intersection of the rods 23 and 28. The notch 30 is employed in connection with a latching mechanism to be described hereinafter.

The L-shaped piston connecting rod 28 includes a horizontal member 31 and a vertical member 32, as shown in FIG. 1. The lower rear portion of the vertical member 32 is secured to the forward end of the piston rod 23, forming notch 30, and the horizontal member 31 extends toward the rear and is telescoped within a slide connecting rod 33 which is located immediately below the barrel 11 between the barrel 11 and the cylindrical chamber 20. The slide connecting rod 33 is connected at its rear end with the slide return spring (not shown), and this return spring is of conventional design in the operation of firearms. The trigger mechanism is also not shown, as the invention is not concerned directly with the operation of the trigger of the return spring of the slide, with these components being of conventional construction so far as their operation with the present invention is concerned.

Located in the lower forward portion of the forestock 18 is a latch mechanism 34, one embodiment of which is shown in FIGS. 1 through 3. The latch mechanism 34 is pivotally mounted on the forestock 18 by pin 40 and includes a forward lug portion 35 which is biased upwardly about pin 40 by spring 37 for the purpose of engaging the notch 30 of the piston connecting rod 28 in order to maintain the piston connecting rod 28 in the forward position with the spring 26 compressed, as shown in FIG. 1. The latch 34 also includes a release member 36 located near the exterior surface of the forestock 18, with the release member 36 being spring operated as shown in FIG. 1 to allow the notch 30 to be released upon pressing the release member 36 against the action of the spring 37.

As described herein, the latch mechanism 34 may be of any conventional design which will operate to retain the piston connecting rod 28 in the forward latched position shown in FIG. 1, and with the capability for releasing the connecting rod 28 to allow the spring 26 to move to the position shown in FIG. 2. Other embodiments of the latch mechanism 34 are shown in FIGS. 4 and 5. Thus the latch mechanism 34*a* of FIG. 4 includes lug portion 35*a* and release member 36*a*, with member 36*a* being pressed by the operator against the action of spring 37*a* to move lug portion 35*a*, thus releasing the piston connecting rod 28. In FIG. 5, the lug portion 35*b* of latch mechanism 34*b* is lever operated about fulcrum 38*b* by pressing upon release member 36*b*.

Figure 7:
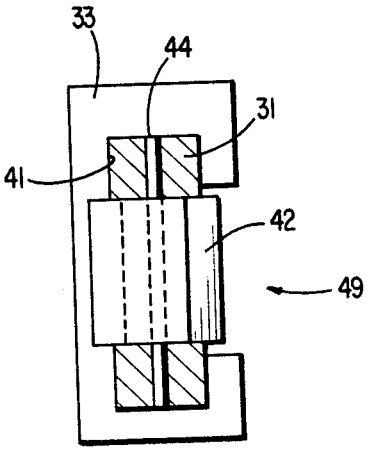
FIG. 7 is a cross-sectional view taken along line 7—7 of FIG. 6.
Figure 8:
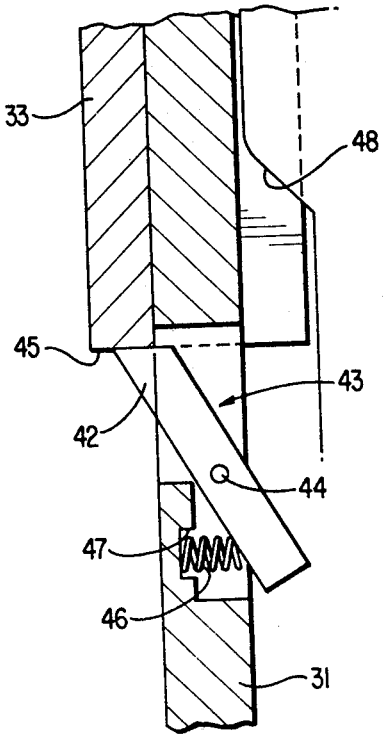
FIG. 8 is a cross-sectional view taken along line 8—8 of FIG. 6, showing the camming action between the slide connecting rod and the piston connecting rod.

In FIGS. 6 through 8, there is shown the relationship between the horizontal member 31 of the piston connecting rod 28 and the slide connecting rod 33 which telescopes over member 31 during operation of the firearm 10. As shown, the member 31 is of rectangular cross-section fitted to slide free in the bore 41 of connecting rod 33. A longitudinally extending stop member 42 is pivotally mounted within cavity 43 of member 31 by means of vertical pivot pin 44. The stop member 42 is urged against the forward end surface 45 of slide connecting rod 33 by spring 46 mounted within cavity 47 of member 31, as shown in FIGS. 6 and 8, when the connecting rod 33 is in position relative to the remainder of the firearm 10 such as shown, for example, in FIGS. 1 and 2.

The stop member 42 functions to bear against the slide connecting rod 33 and thus move the slide connecting rod 33 rearwardly simultaneously with the horizontal member 31 of the piston connecting rod 28, under action of the spring 26 upon release of the latch mechanism 34. At the end of this rearward motion, the slide connecting rod 33 will have positioned the slide so that the slide operates in a conventional manner to open the bolt (not shown) and allow the empty shell to be thrown out of the barrel 11. At this point, which is at the end of the rearward movement of member 31, the stop member 42 will engage cam member 48 positioned adjacent the opening 49 in the side of slide connecting rod 33. Cam surface 48 will bear against the pressure of spring 46 on the rear portion of member 42 so as to align stop member 42 longitudinally with member 31 and freeing slide connecting rod 33 to move forwardly under the action of the firearm return spring (not shown), bringing a new round into the chamber 14 ready to be fired.

In the operation of the present invention, a round is fired in barrel 11, and as the bullet passes the gas port 19, the gases from the explosion enter the gas port and are received by cylinder 20 at the rearward end thereof. As the gas pressure instantaneously increases, the piston 21 within cylinder 20 is moved forwardly along the interior of cylinder 20 to compress and load spring 26 until latch 34 is received by notch 30, as shown in FIG. 1. The piston 21 and spring 26 will remain in this latched position until forestock release mechanism 36 is actuated, at which time the piston 21 will move rearwardly under pressure from spring 26, with the piston connecting rod member 31 engaging the slide connecting rod 33 through stop member 42, as shown in FIG. 2. In this manner, the slide connecting rod 33 engages the slide which in turn opens the bolt in a conventional manner and discharges the empty shell, at the end of the rearward stroke of the slide connecting rod 33.

At the end of the rearward stroke of the slide connecting rod 33, the stop member 42 engages cam surface 48, thus freeing stop member 42 from slide connecting rod 33 and allowing the slide connecting rod 33 to move forwardly under action of the firearm return spring, so that the slide connecting rod 33 telescopes on the piston connecting rod member 31, bringing a new round into the chamber 14 ready to be fired, as shown in FIG. 3.

An important feature of the present invention is the anti-recoil effect obtained as the piston 21 and piston connecting rod 28 move in a direction opposite to the recoil, immediately upon the firing of a round.

Any rifle constructed so as to include the present invention would provide the same result as a single shot firearm. The present invention may be employed with semi-automatic or fully automatic firearms and thus provide diversification of loading capability in a single firearm. An additional beneficial aspect of the present invention is the safety feature, whereby the shooter can maintain the gun in an empty condition at all times, and with the capability, when needed, for reloading in a split second without moving the gun sight off the target.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely preferred embodiments thereof.

I claim:

1. In a firearm having a barrel with a bore extending the length thereof, a receiver secured to the rear portion of the barrel, said receiver defining a cartridge-receiving chamber, said chamber having an open breech, a bolt for closing the breech, a driving spring for operating the bolt to close the breech, and an operating slide slidably mounted in the receiver for operation of the driving spring, the improvement for storing energy from the gases released during discharge of a cartridge through the barrel which comprises: a cylindrical chamber mounted below and parallel to said barrel; a vent positioned between said cylindrical chamber and the bore of the barrel to allow passage of gases from the bore to the rear end portion of the cylindrical chamber; a piston having a head and a rod and being mounted in gas-tight sliding relationship within the cylindrical chamber, the head of said piston being mounted so as to receive against its rearwardly facing surface the pressure of gases entering the cylindrical chamber from the barrel, the rod of said piston extending through the forward end of the cylindrical chamber in sliding, gas-tight relationship with said forward end; a spring mounted on the piston rod between the forward surface of the piston head and the forward end of the cylindrical chamber; a L-shaped piston-connecting rod secured to the forward end of said piston rod, said piston connecting rod extending upwardly and rearwardly from its connection with the piston rod; a notch formed in the piston rod at its point of attachment to the piston connecting rod; a forestock grip member secured to the barrel and receiver, said forestock member extending around the exterior of the cylindrical chamber and piston connecting rod; a latch member secured to the interior of said forestock member, said latch member releasably securing the notch when the piston is at the limit of its forward motion; means located on the exterior of the forestock for actuating the latch to release the notch; a slide connecting rod secured at its rear end portion to the slide and having a bore therein at its forward end for receiving the rearwardly extending portion of the piston connecting rod; biasing means mounted on the piston connecting rod for biasing the slide connecting rod in a rearwardly direction, and cam means for releasing said biasing means when the slide connecting rod reaches the limit of its rearward motion.

* * * * *